US006694037B1

(12) United States Patent
Robinson et al.

(10) Patent No.: US 6,694,037 B1
(45) Date of Patent: Feb. 17, 2004

(54) SPIDER-LESS LOUDSPEAKER WITH ACTIVE RESTORING APPARATUS

(76) Inventors: Robert Steven Robinson, 317 Ranch House Rd. North, Angleton, TX (US) 77515; William B. Rottenberg, 106 Paintbrush, Lake Jackson, TX (US) 77566; André G. Routh, 323 Rosemary La., Lake Jackson, TX (US) 77566

( * ) Notice: Subject to any disclaimer, the term of this patent is extended or adjusted under 35 U.S.C. 154(b) by 0 days.

(21) Appl. No.: 09/459,745

(22) Filed: Dec. 10, 1999

(51) Int. Cl.[7] ..... H04R 25/00
(52) U.S. Cl. ..... 381/398; 381/401
(58) Field of Search ..... 381/398, 396, 381/423, 400, 401, 431, 432, 403; 181/171, 172, 173, 148, 164

(56) References Cited

U.S. PATENT DOCUMENTS 1,822,450 A * 9/1931 Nystrom ..... 181/173
4,207,430 A 6/1980 Harada et al. ..... 179/1 F
4,334,127 A 6/1982 Shimada et al. ..... 179/115.5 R
4,727,584 A 2/1988 Hall ..... 381/96
5,408,533 A 4/1995 Reiffin ..... 381/96
5,748,759 A * 5/1998 Croft et al. ..... 181/171
5,786,741 A 7/1998 Leibzon ..... 335/222
5,828,767 A 10/1998 Button ..... 381/195
5,848,173 A 12/1998 Sato et al. ..... 381/398

* cited by examiner

*Primary Examiner*—Huyen Le
*Assistant Examiner*—Brian Ensey
(74) *Attorney, Agent, or Firm*—John R. Merkling

(57) ABSTRACT

A spider-less and suspension-less speaker system, having a diaphragm constrained to move in a linear direction and supported by a frictionless or low friction support. A voice coil coupled to an audio input drives the speaker diaphragm. A position sensor determines the physical position of the diaphragm. A control circuit uses the sensed position information to modify the audio signal in such a way that the interaction of the voice coil and the magnetic field both drives the diaphragm to produce an audible output and restores the diaphragm to a neutral position in the absence of a further audio signal.

37 Claims, 5 Drawing Sheets

SPIDER-LESS LOUDSPEAKER WITH ACTIVE RESTORING APPARATUS

FIELD OF THE INVENTION

The present invention relates to the fields of audio loudspeakers, and more particularly to a speaker suspended without a "spider" or "surround," wherein the motion of the speaker is controlled by an active restoring apparatus.

BACKGROUND OF THE INVENTION

A representative prior art audio speaker 10 is illustrated in FIG. 1. Most speakers, like speaker 10, comprise a diaphragm 12 driven by a voice coil 14. The voice coil 14 is mounted in a magnetic field created by magnet 22. The magnet 22 is supported on a back plate 18 and has a top plate 16 and a pole piece 20 forming a magnetic assembly 23. The diaphragm 12 is supported in such a way that it is free to vibrate in a linear direction, restrained by a spring apparatus. Usually the spring apparatus takes the form of a surround 24 and a spider 26. When an audio signal is fed to the coil 14, the diaphragm 12 moves away from a neutral position. The spider 26 and surround 24 act both to constrain speaker to a linear motion and to provide a restoring force, returning the diaphragm 12 to the neutral position in the absence of a displacing force provided by the coil 14.

The spring action in the spider and surround are potentially distorting to sound reproduction, particularly where wide ranges of frequencies or amplitudes are expected. The spider and surround usually act as linear springs over most of their range of motion, coming to a relatively abrupt stop at maximum extension in either the forward or backward direction. In certain situations, particularly with high audio power and at low bass frequencies, the speaker may be driven beyond its physical constraints, striking a hard constraint or straining against the suspension at its limit, a phenomenon referred to as "bottoming." Bottoming can introduce serious distortion and risk physical damage or deterioration of the speaker.

It is an object therefore, of our invention, to provide a speaker system without a spring-type suspension.

It is also an object of our invention to provide a speaker with an active restoring apparatus.

Another feature or object of our invention is to provide a speaker with a frictionless bearing, that is, negligible friction, constraint, the constraint limiting direction travel of the diaphragm to a linear direction.

SUMMARY OF THE INVENTION

The objects of our invention have been accomplished by providing a spider-less and suspension-less speaker system, having a diaphragm constrained to move in a linear direction and supported by a frictionless or low friction support. A voice coil coupled to an audio input drives the speaker diaphragm. A position sensor determines the physical position of the diaphragm. A control circuit uses the sensed position information to modify the audio signal in such a way that the interaction of the voice coil and the magnetic field both drives the diaphragm to produce an audible output and restores the diaphragm to a neutral position in the absence of a further audio signal.

BRIEF DESCRIPTION OF THE DRAWINGS

The above and further objects, features and advantages of the present invention will be more fully understood from the following description, taken with reference to the accompanying drawings.

DETAILED DESCRIPTION

We will now describe our invention by reference to the drawings. Like numerals are used to designate like parts in all the drawings.

Figure 2:
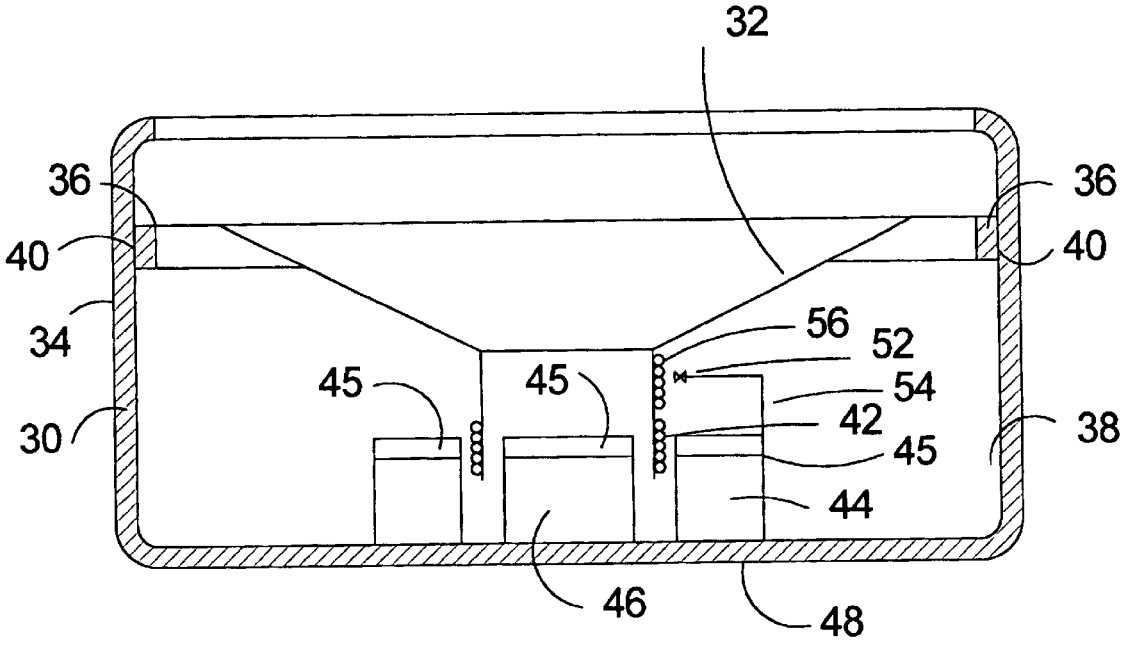
FIG. 2 is a cross-sectional plan view of a speaker according to our invention.

FIG. 2 is a cross-sectional representation of an audio speaker 30 according to our invention. The audio speaker 30 comprises a diaphragm 32 supported in a frame 34 by sliding frictionless or low friction bearings 36. Frictionless bearings 36 constrain the diaphragm to motion in a linear direction. For this purpose, a low friction -inner surface 38 may be provided on the frame 34. Contacts 40 abut the surface 38. The contacts 40 may be a block comprised of a suitable material, such as high-density polyurethane or may have a Teflon (trademark) coated surface or other suitable sliding surface. Alternatively, roller or other bearings configured to contact the surface 38 may be used. The bearings 36 may have the capacity to resist torque so that the diaphragm 32 will remain perpendicular to the selected linear direction of motion.

Figure 3:
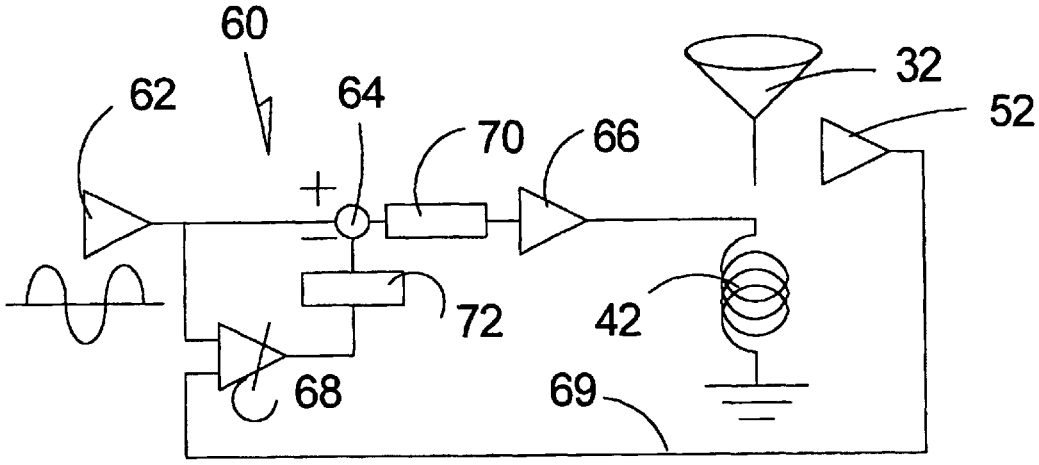
FIG. 3 is a schematic diagram of a first control circuit.
Figure 4:
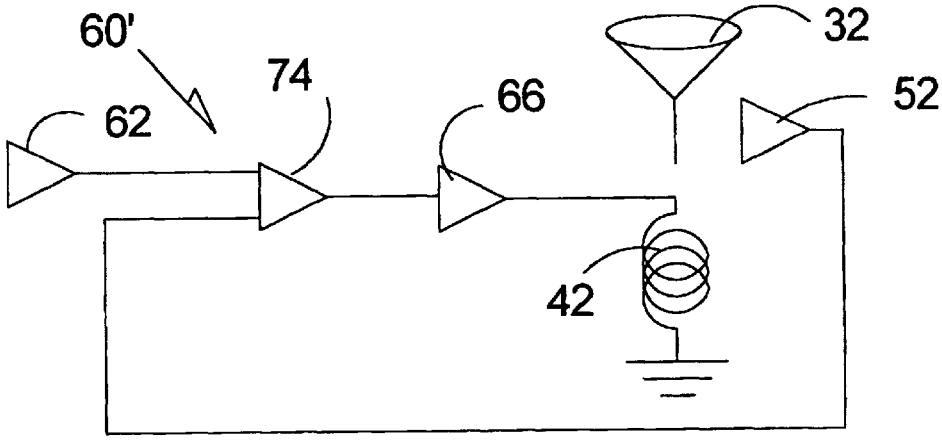
FIG. 4 is a schematic diagram of a second control circuit.
Figure 5:
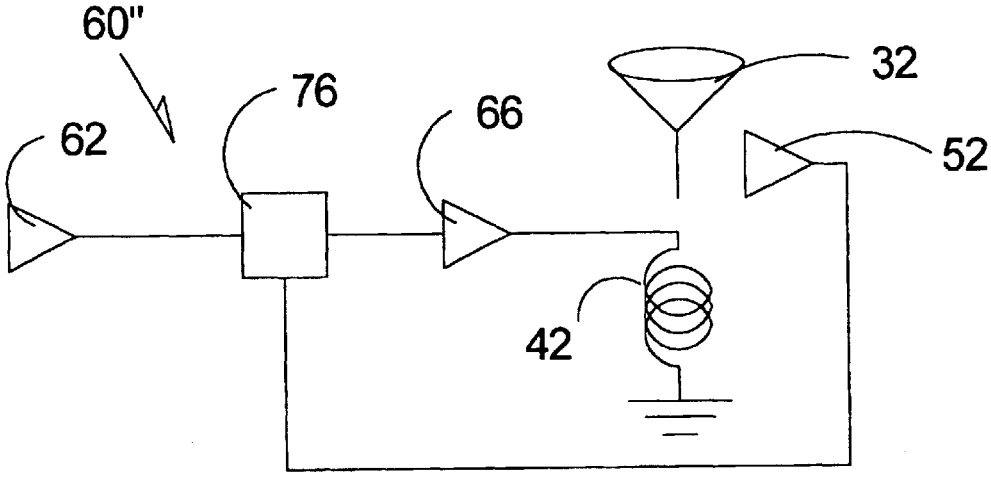
FIG. 5 is a schematic of a third control circuit.

The diaphragm 32 is connected to a voice coil 42 which lies generally within a magnetic field provided by magnet assembly 44. Magnets 45 and a pole piece 46 are supported on a base 48 of the frame 34. Preferably underhung construction is used. See, for example, U.S. Pat. No. 5,408,533, the disclosure of which is incorporated herein by reference. The voice coil 42 is connected to an audio signal as illustrated in FIGS. 3 through 5. FIG. 2 illustrates a position sensor 50. The position sensor 50 may be any suitable sensor capable of determining the relative position of the diaphragm 32 to a reference position. In FIG. 2, an optical sensor 52 is illustrated. The optical sensor 52 is connected by electrical lead 54 to control circuitry to be described in connection with FIGS. 3 through 5. Surface 56 on or near the voice coil 42 either reflects light from the optical sensor 52 or provides its own light source which can be sensed by the optical sensor 52, whereby the sensor 52 is able to determine the relative location of the diaphragm and to provide a signal representative thereof.

The motion of the diaphragm 32 in the selected linear direction is controlled by a control circuit 60. The position sensor 52 is coupled to the diaphragm 32 and driven by the voice coil 42. An audio signal from an audio source 62 is directed through the voice coil 42. Displacement of the diaphragm 32 from the normal position is sensed through the position sensor 52 and, in the embodiment of FIG. 3, is directed through a feedback junction 64 to provide negative feedback. An amplifier or buffer 66 may further be provided between the feedback loop 69 and the coil 42. The feedback loop 69 substantially modifies the input signal before that signal is fed to the coil 42 so that the magnetic field provides not only the driving force but also the restoring force bringing the diaphragm back to a neutral position.

Additional signal processing may also be provided to more fully condition the signal being delivered to the coil 42. A variable differential amplifier 68 connected in the feedback loop may be used to provide a variable tightness, that is, the magnitude of restoring force added into the signal to return the diaphragm quickly or slowly to the neutral position. By analogy, changing the "tightness" is like varying the spring constant, of the spider or surround, whereby a more or less responsive speaker may be produced to match the quality of the audio signal. In standard speakers, of course, the physical characteristics of the surround or spider cannot be so altered. Additional signal modification may be provided by inserting a feed forward circuit 70 between the feedback connections 64 and coil 42. The feed forward circuit 70 may be implemented as a digital signal processor using the known mass of the diaphragm, available linear displacement distance, and any frictional losses to calculate a restoring force necessary to counteract the driving force being produced in response to the audio signal. The delay in applying the restoring force is a measure of the responsiveness of the speaker. In contrast to a speaker supported by a spider and surround, the responsiveness can be adjusted to provide varying speaker response. The signal may be critically damped, over damped or under damped, according to taste of a user. Thus the characteristics of the speaker can be controlled, for example, to suit the type of music to be played through the speaker.

Between the variable differential amplifier 68 and the feedback connections 64, a damping circuit 72 may be provided to prevent or restrict overshoot or undershoot of the diaphragm 32. The damping circuit 72 corrects the motion of the diaphragm 32 for excessive errors, that is, for motion which would fall outside predetermined limits. The circuit 72 may be implemented digitally and may be used without the variable differential amplifier 68.

An alternative control circuit 60' is illustrated in FIG. 4. In the control circuit 60' of FIG. 4, the feedback junction 64 has been replaced by a differential amplifier 74. Yet another embodiment of a control circuit 60" is illustrated in FIG. 5. In this instance, a digital feed forward circuit 76, similar to the circuit 70 of FIG. 3, performs the function of signal modification. In the digital feed forward circuit 76, damping feedback and variable tightness may be provided by setting selected parameters, as mentioned above.

Figure 6:
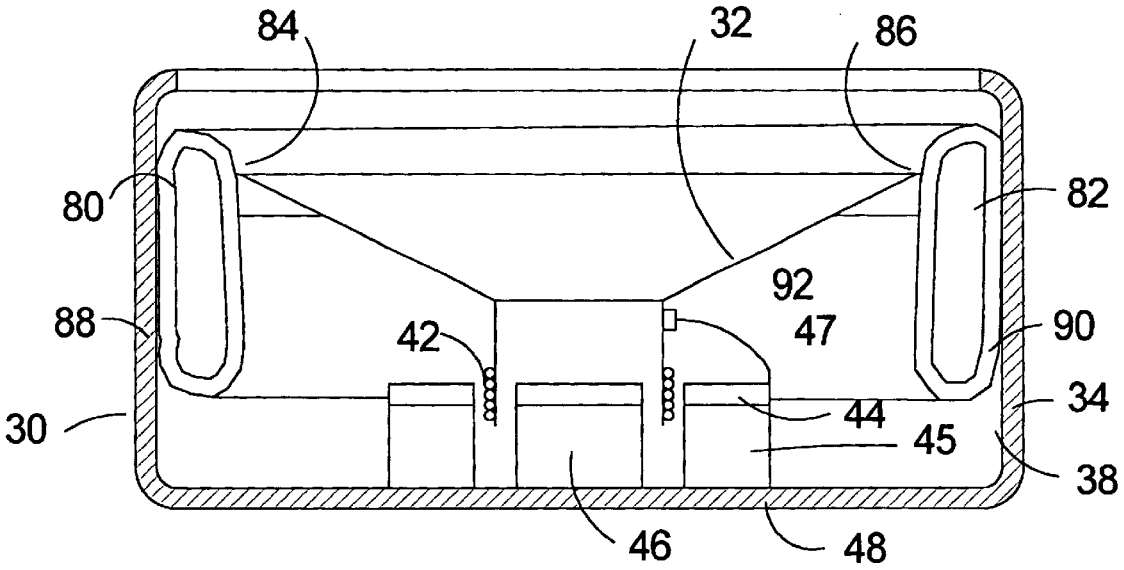
FIG. 6 is an additional embodiment of the speaker of our invention with an alternative position sensor and support.

FIG. 6 illustrates an alternative embodiment of our invention, having endless loop bearings 80 to provide the frictionless or low friction connection between the frame 34 and the diaphragm 32. The endless loop bearings 80 are elastomeric tube segments, the tube segments having a circumference and a length. The length is perpendicular to the direction of linear translation of the diaphragm 32. Each of the endless loop bearings 80, 82 have an outer surface and are connected to the diaphragm. The frame 34 has a surface 38 parallel to the direction of linear translation of the diaphragm 32. The outer surface of the endless loop bearing 80, 82 is in rolling contact with the surface 38 of the frame 34. The endless loop bearings may be connected lengthwise at a first line of contact 88, 90 to the frame and may also be connected lengthwise at a second line of contact 84, 86 to said diaphragm. The second line of contact is spaced apart from the first line of contact. Preferably, the second line of contact 84, 86 is equidistant around the circumference from the first line of contact 88, 90. We prefer to provide a plurality of endless loop bearings, spaced around the diaphragm, and more preferably at least three loop bearings spaced around the diaphragm to stabilize the diaphragm and allow motion only in a selected linear direction. In the embodiment of FIG. 6 an alternative position sensor is also shown. A miniature accelerometer 92 is mounted on or near the diaphragm so as to move with the diaphragm. Piezoelectric accelerometers are known. See, e.g. U.S. Pat. No. 4,727,584 and U.S Pat. No. 5,014,703. The output of the accelerometer is directly related to acceleration, rather than position as such. The output must, therefore, be integrated twice to give position information.

Figure 7:
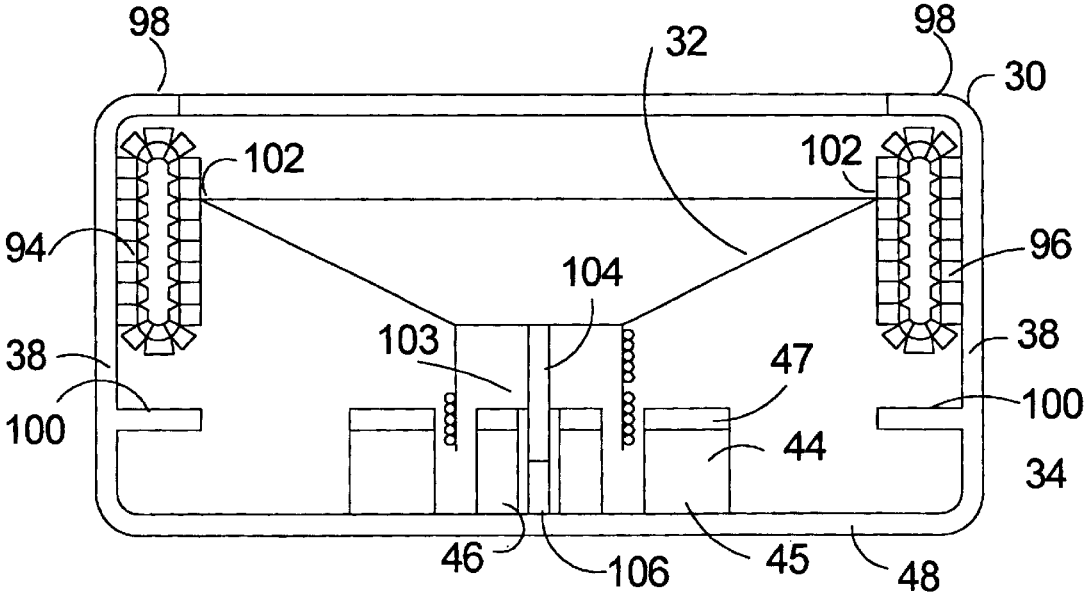
FIG. 7 is an another embodiment of the speaker of our invention with an alternative position sensor in an alternative support.
Figure 8:
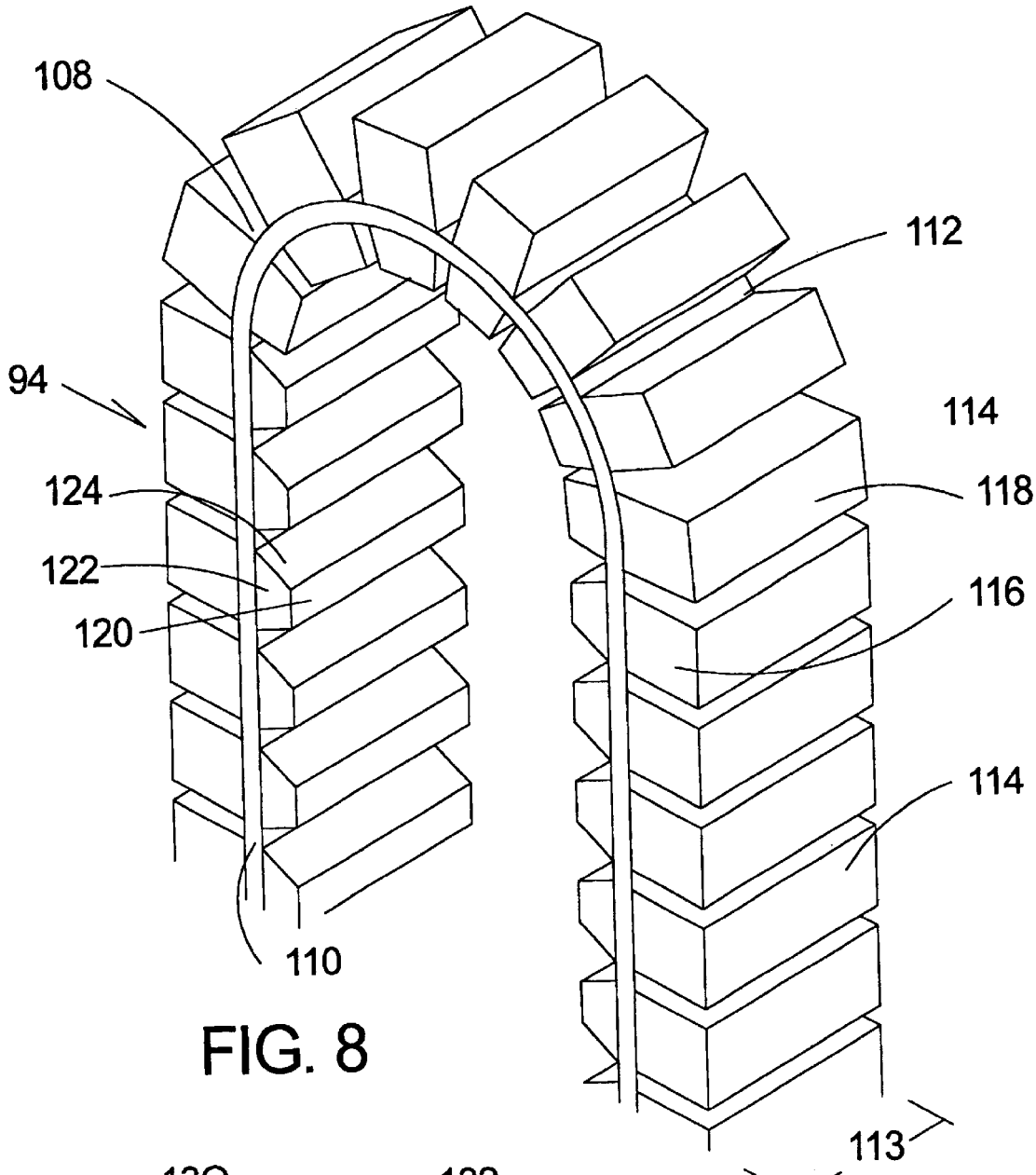
FIG. 8 is a proportional prospective view of one of the supports of FIG. 7.

Yet another embodiment of our invention is illustrated in FIG. 7 and FIG. 8. In this embodiment, endless loop bearings 94, 96 comprise an elastomeric tube segment 108 (see FIG. 8) having an inner surface 110, an outer surface 112, a circumference and a length 113 perpendicular to the direction of linear translation of the diaphragm. There is a plurality of rectangular prisms 114 on the outer surface. Each of the rectangular prisms 114 has a rectangular base 116 and a height 118 perpendicular to the base. Preferably, the height is parallel to the length of the tube 108. On the inner surface 110 of the tube 108 there are trapezoidal prisms 120. Each of the trapezoidal prisms 120 have a trapezoidal ase 122 and a height 124 perpendicular to the base 122 and preferably parallel to the length 113 of the tube 108. A selected rectangular prism 102 (see FIG. 7) of the rectangular prisms 114 is connected to the diaphragm 32, but the endless bearings 94, 96 are not connected to the frame 34. Rather the bearings oscillate in a cavity formed by the inner surface 38 of the frame and a first flange 98 and a second flange 100. Adjacent the flanges, the bearing folds back on itself as seen in FIG. 8. The trapezoidal prisms come together while the rectangular prisms spread apart. Between the flanges, the rectangular prisms lie adjacent each other and keep the bearing relatively straight. FIG. 7 also illustrates an alternative position sensor, namely, a linear variable displacement transducer 103. The transducer 103 comprises a plunger 104 and a coil 106. The relative position of the plunger within the coil 106 changes the mutual reactance of the coil in a manner directly related to the position of the plunger. Since the plunger 104 is coupled to the diaphragm, the position of the diaphragm is also known. A linear variable displacement transducer is available from Macro Sensors, Inc., for example.

Figure 1:
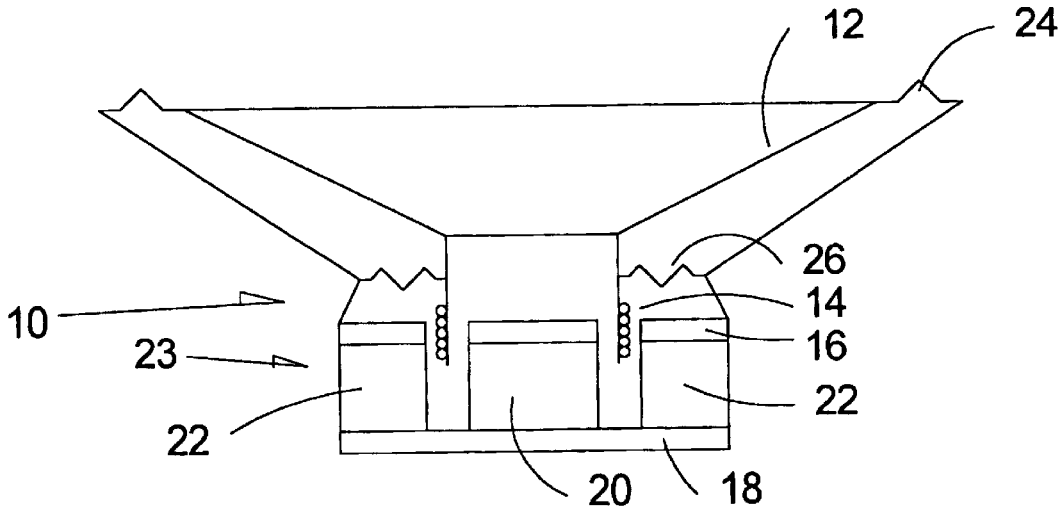
FIG. 1 PRIOR ART
FIG. 1 is a cross-sectional plan view of a prior art speaker.
Figure 9:
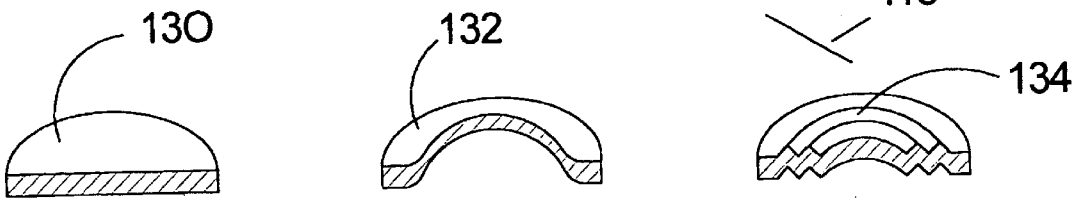
FIG. 9 is a series of perspective through sections of speaker diaphragms for use with the speaker of our invention.

Standard audio speakers, such as the speaker 10 of FIG. 1, often have conical diaphragms to resist the spring action of the surround or spider without physically distorting the diaphragm. Since the speaker of our invention does not have a spring-type support, alternative shapes for the diaphragm can more easily be used. These shapes can cause the audio wave front produced by the speaker to more closely represent a point source of sound, thus further reducing distortion. For example, instead of a conical diaphragm, a planar diaphragm 130, as shown in through section in FIG. 9, might be used. Alternatively, a domed diaphragm 132, convex in a direction of maximum sound propagation, could be used. In such a diaphragm, the center of curvature of the diaphragm would be the apparent point source of the sound. A similar effect, but with a flatter profile for the diaphragm, might be achieved by a diaphragm 134 having the configuration of a Fresnel lens. Other diaphragm configurations could, of course also be used with the speaker of our invention.

Figure 10:
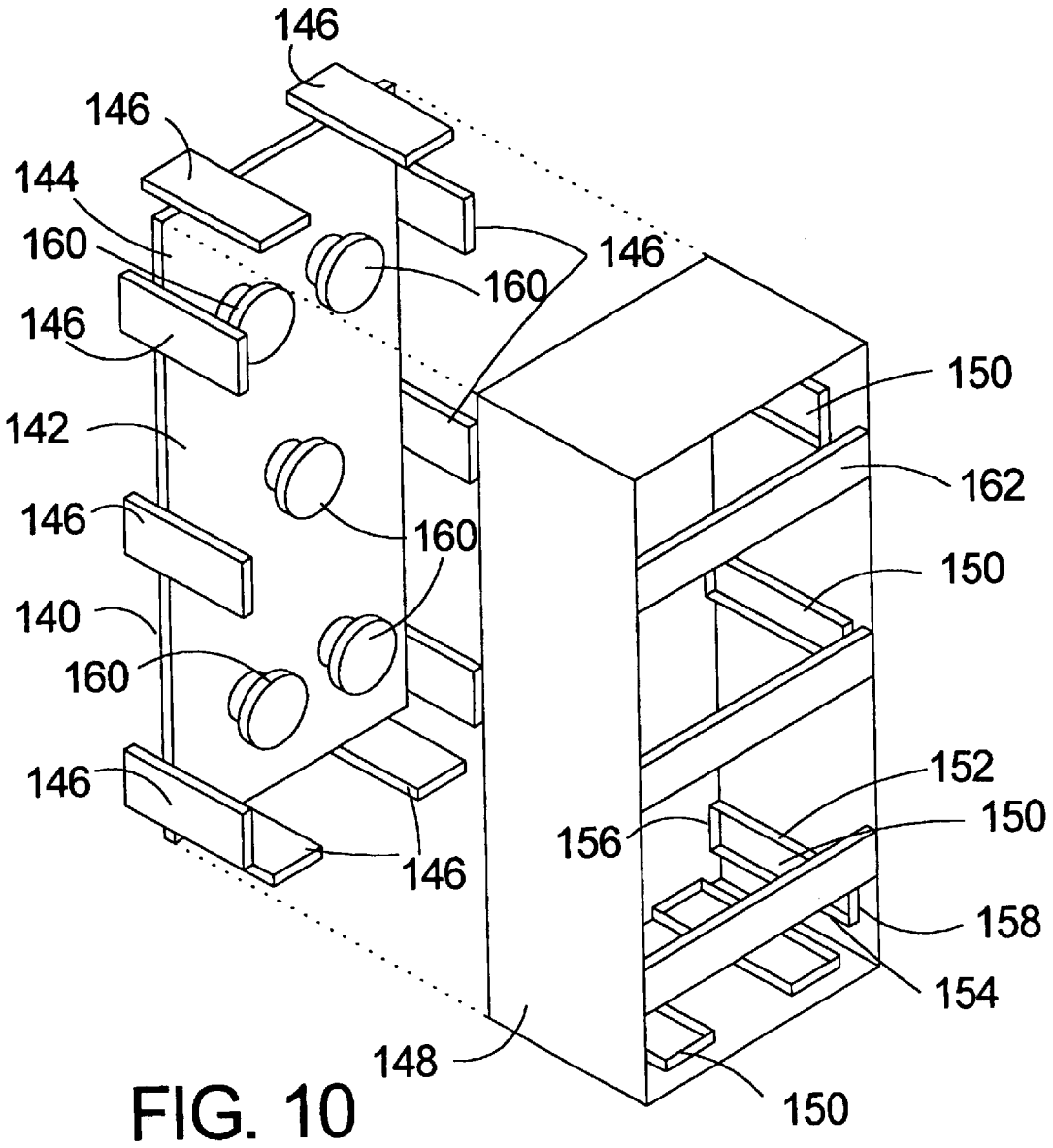
FIG. 10 is an exploded perspective view of a planar speaker with multiple drivers.

Our invention may be particularly useful for large speakers. In large speakers, the spider or surround tends to distort the shape of the speaker, that is, there is more motion near the attachment point for the speaker diver and less motion at the edges, near the spider or surround. Moreover, it is difficult to use multiple drivers in a single speaker, because the drivers are not exactly in phase with one another. Since the drivers of our invention are position-controlled, multiple in-phase drivers can be attached to a single speaker diaphragm. For example, an exploded perspective view of a multiple-driver speaker 140 is illustrated in FIG. 10. The multiple driver speaker 140 comprises a larger diaphragm 142. A planar diaphragm is illustrated but other configurations, as explained above, could also be used. The rectangular shape shown in FIG. 10, which may be on the order of a meter by two meters, may be replaced by other configurations, for example a polygon such as an octagon, or a circular or elliptical configuration. Around an edge 144 of the diaphragm 142 a plurality of bearings 146 are mounted. These may be endless loop bearings like those described above in connection with FIG. 6, FIG. 7 or FIG. 8. A frame 148 supports a plurality of tracks 150 for the bearings 146. Side walls 152, 154 guide the bearings 146 to keep the motion of the diaphragm linear. End walls 156, 158 perform the function of the flanges 98, 100 described in connection with FIG. 7 above.

A plurality of drivers 160 are attached to the diaphragm. Each of the drivers 160 is of the type described above and has a displacement sensor, such as the optical sensor 52, accelerometer 92 or linear variable displacement transducer 103. Each is connected through a control circuit such as circuit 60, 60' or 60". Support brackets 162 in the frame 148 connect to the drivers 160 and provide mechanical support for the divers 160. Because the drivers are position sensitive, they are in phase with each other and can be used to drive a very large diaphragm. Because the diaphragm is not connected to the frame by a spider or surround, the diaphragm is not distorted by the differing distances of the various drivers 160 from the edge 144 of the diaphragm 142.

The foregoing examples of embodiments of our invention should be deemed exemplary only. Those skilled in the art will recognize that changes and modifications could be made in the design or construction without departing from the scope or teachings of our invention. It is intended, therefore, that the scope of our invention should be defined by the accompanying claims.

What is claimed is:

1. An audio speaker comprising a frame;

a diaphragm;

a plurality of physically independent, non-concentric voice coils, all of said voice coils being mechanically coupled to said diaphragm, an audio signal input;

bearings supporting said diaphragm and constraining the motion of said diaphragm to a selected linear translation within said frame, said bearings being the sole means for supporting said diaphragm and said voice coil;

a position sensor coupled between said frame and said diaphragm and sensing a linear displacement of said diaphragm, and a control circuit having inputs from said sensor and said audio signal input, and an output to said voice coil.

2. The audio speaker of claim 1 wherein said control circuit comprises a negative feedback circuit.

3. The audio speaker of claim 2 wherein said control circuit further comprises a variable differential amplifier having inputs from said audio signal input and said position sensor and an output to said negative feedback circuit.

4. The audio speaker of claim 3, wherein said control circuit comprises a feed forward circuit interposed at an output of said negative feedback circuit.

5. The audio speaker of claim 4 wherein said control circuit comprises a digital damping circuit interposed between said variable differential amplifier and said negative feedback circuit.

6. The audio speaker of claim 3 wherein said control circuit comprises a digital damping circuit interposed between said variable differential amplifier and said negative feedback circuit.

7. The audio speaker of claim 1 wherein said control circuit comprises a differential amplifier.

8. The audio speaker of claim 1 wherein said control circuit comprises a digital feed forward circuit.

9. The audio speaker of claim 1 wherein said position sensor comprises an optical sensor.

10. The audio speaker of claim 1 wherein said position sensor comprises an accelerometer.

11. The audio speaker of claim 1 wherein said position sensor comprises a linear variable displacement transducer.

12. The audio speaker of claim 1 wherein said position sensor comprises a magnetic field sensor.

13. The audio speaker of claim 1 wherein said bearings comprise endless loop bearings.

14. An audio speaker comprising a frame;

a diaphragm;

a voice coil mechanically coupled to said diaphragm, an audio signal input:

endless loop bearings comprising elastomeric tube segments, said tube segments having a circumference and a length, said length being perpendicular to said linear translation of said diaphragm, said endless loop bearings being connected lengthwise at a first line of contact to said frame and also being connected lengthwise at a second line of contact to said diaphragm, said second line of contact being spaced apart from said first line of contact, said endless loop bearings supporting said diaphragm and constraining the motion of said diaphragm to a selected linear translation within said frame, said bearings being the sole means for supporting said diaphragm and said voice coil, a position sensor coupled between said frame and said diaphragm and sensing a linear displacement of said diaphragm, and a control circuit having inputs from said sensor and said audio signal input, and an output to said voice coil.

15. The audio speaker of claim 14 wherein said second line of contact is equidistant around said circumference from said first line of contact.

16. An audio speaker comprising a frame;

a diaphragm;

a voice coil mechanically coupled to said diaphragm, an audio signal input;

endless loop bearings having an outer surface and are connected to said diaphragm and wherein said frame further comprises a surface parallel to said linear translation of said diaphragm, said outer surface being in rolling contact with said parallel surface, said endless loop bearings supporting said diaphragm and constraining the motion of said diaphragm to a selected linear translation within said frame, said bearings being the sole means for supporting said diaphragm and said voice coil, a position sensor coupled between said frame and said diaphragm and sensing a linear displacement of said diaphragm, and a control circuit having inputs from said sensor and said audio signal input, and an output to said voice coil.

17. An audio speaker comprising a frame;

a diaphragm;

a voice coil mechanically coupled to said diaphragm, an audio signal input;

endless loop bearings, at least one of said endless loop bearings comprising an elastomeric tube segment having an inner surface, an outer surface, a circumference and a length and a plurality of rectangular prisms on said outer surface, said prisms having a rectangular base and a height perpendicular to said base, said height being parallel to said length of said tube, said endless loop bearings supporting said diaphragm and constraining the motion of said diaphragm to a selected linear translation within said frame, said bearings being the sole means for supporting said diaphragm and said voice coil, a position sensor coupled between said frame and said diaphragm and sensing a linear displacement of said diaphragm, and a control circuit having inputs from said sensor and said audio signal input, and an output to said voice coil.

18. The audio speaker of claim 17 wherein said at least one of said endless loop bearings further comprises a plurality of trapezoidal prisms on said inner surface, said prisms having a trapezoidal base and a height perpendicular to said base, said height being parallel to said length of said tube.

19. An audio speaker comprising a frame;

a diaphragm;

a voice coil mechanically coupled to said diaphragm, an audio signal input;

endless loop bearings, at least one of said endless loop bearings comprising an elastomeric tube segment having an inner surfa, an outer surface, a circumference and a length and a plurality of trapezoidal prisms on said inner surface, said prisms having a trapezoidal base and a height perpendicular to said base, said height being parallel to said length of said tube, said endless loop bearings supporting said diaphragm and constraining the motion of said diaphragm to a selected linear translation within said frame, said bearings being the sole means for supporting said diaphragm and said voice coil, a position sensor coupled between said frame and said diaphragm and sensing a linear displacement of said diaphragm, and a control circuit having inputs from said sensor and said audio signal input, and an output to said voice coil.

20. An audio speaker comprising a frame;

a diaphragm;

a voice coil being mechanically coupled to said diaphragm, an audio signal input;

bearings comprising a surface mounted on said frame, said surface having a length parallel to said selected translation of said diaphragm and at least one contact block attached to said diaphragm and abutting said surface, bearings supporting said diaphragm and constraining the motion of said diaphragm to a selected linear translation within said frame, said bearings being the sole means for supporting said diaphragm and said voice coil;

a position sensor coupled between said frame and said diaphragm and sensing a linear displacement of said diaphragm, and a control circuit having inputs from said sensor and said audio signal input, and an output to said voice coil.

21. The audio speaker of claim 20 wherein said surface comprises a polished surface.

22. The audio speaker of claim 20 wherein said contact block is a high-density polymer.

23. The audio speaker of claim 20 wherein said contact block comprises a rolling bearing.

24. An audio speaker comprising a frame;

a diaphragm;

a voice coil mechanically coupled to said diaphragm and having an audio signal input, said linear voice coil providing the sole linear forces to said diaphragm;

a position sensor coupled between said frame and said diaphragm and sensing a linear displacement of said diaphragm, and a control circuit having an input from said sensor and from an audio signal and having an output to said audio signal input of said voice coil, said control circuit producing a signal to said voice coil to produce an audible output from said diaphragm and to restore said diaphragm to a neutral position, said diaphragm being restored to said neutral position solely in response to said signal.

25. The audio speaker of claim 24 comprising a plurality of physically independent, non-concentric voice coils, all of said voice coils being mechanically coupled to a single diaphragm.

26. The audio speaker of claim 24 wherein said control circuit comprises a negative feedback circuit.

27. The audio speaker of claim 26 wherein said control circuit further comprises a variable differential amplifier having inputs from said audio signal input and said position sensor and an output to said negative feedback circuit.

28. The audio speaker of claim 27 wherein said control circuit comprises a feed forward circuit interposed at an output of said negative feedback circuit.

29. The audio speaker of claim 28 wherein said control circuit comprises a digital damping circuit interposed between said variable differential amplifier and said negative feedback circuit.

30. The audio speaker of claim 27 wherein said control circuit comprises a digital damping circuit interposed between said variable differential amplifier and said negative feedback circuit.

31. The audio speaker of claim 24 wherein said control circuit comprises a differential amplifier.

32. The audio speaker of claim 24 wherein said control circuit comprises a digital feed forward circuit.

33. The audio speaker of claim 24 wherein said position sensor comprises an optical sensor.

34. The audio speaker of claim 24 wherein said position sensor comprises an accelerometer.

35. The audio speaker of claim 24 wherein said position sensor comprises a linear voltage displacement transducer.

36. The audio speaker of claim 24 wherein said position sensor comprises a magnetic field sensor.

37. An audio speaker comprising a frame;

a diaphragm;

a plurality of physically independent, non-concentric voice coils, all of said voice coils mechanically coupled to said diaphragm and having an audio signal input said diaphragm and said voice coils being supported in said frame without spring means;

a position sensor coupled between said frame and said diaphragm and sensing a linear displacement of said diaphragm, and a control circuit having inputs from said sensor and said audio signal input and an output to said voice coil, said control circuit producing a signal to said voice coil to both drive said voice coil to produce sounds and to restore said diaphragm to a neutral position.

* * * * *